US009368096B2

(12) United States Patent
Murthy et al.

(10) Patent No.: US 9,368,096 B2
(45) Date of Patent: Jun. 14, 2016

(54) METHOD AND SYSTEM FOR ACTIVE NOISE CANCELLATION ACCORDING TO A TYPE OF NOISE

(71) Applicant: Texas Instruments Incorporated, Dallas, TX (US)

(72) Inventors: Nitish Krishna Murthy, Allen, TX (US); Edwin Randolph Cole, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 408 days.

(21) Appl. No.: 13/722,040

(22) Filed: Dec. 20, 2012

(65) Prior Publication Data

US 2013/0156214 A1 Jun. 20, 2013

Related U.S. Application Data

(60) Provisional application No. 61/578,017, filed on Dec. 20, 2011.

(51) Int. Cl.
*G10K 11/00* (2006.01)
*G10K 11/178* (2006.01)

(52) U.S. Cl.
CPC ..... *G10K 11/002* (2013.01); *G10K 11/178* (2013.01); *G10K 2210/12* (2013.01); *G10K 2210/1281* (2013.01); *G10K 2210/1282* (2013.01); *G10K 2210/30351* (2013.01)

(58) Field of Classification Search
USPC ..... 381/71.11, 71.6, 94.7; 382/100
See application file for complete search history.

(56) References Cited

U.S. PATENT DOCUMENTS

| | | | | |
|---|---|---|---|---|
| 2005/0094848 | A1* | 5/2005 | Carr et al. | 382/100 |
| 2008/0049953 | A1* | 2/2008 | Harney | H04R 1/245 381/94.7 |
| 2012/0057720 | A1* | 3/2012 | Van Leest | 381/71.11 |

* cited by examiner

*Primary Examiner* — Md S Elahee
(74) *Attorney, Agent, or Firm* — Michael A. Davis, Jr.; Frank D. Cimino

(57) ABSTRACT

Microphone signals are received from a microphone. The microphone signals represent first sound waves. A determination is made about a type of noise that likely exists in the first sound waves. In response to the type of noise, cancellation signals are generated by filtering the microphone signals with at least one of: a first filter in response to the type of noise indicating that a first type of noise likely exists in the first sound waves; and a second filter in response to the type of noise indicating that a second type of noise likely exists in the first sound waves. In response to the cancellation signals, second sound waves are output from a speaker for cancelling at least some noise in the first sound waves.

10 Claims, 2 Drawing Sheets

METHOD AND SYSTEM FOR ACTIVE NOISE CANCELLATION ACCORDING TO A TYPE OF NOISE

CROSS-REFERENCE TO RELATED APPLICATION

This application claims priority to U.S. Provisional Patent Application Ser. No. 61/578,017, filed Dec. 20, 2011, entitled FEEDFORWARD CODEBOOK BASED ANC SYSTEM, naming Nitish K. Murthy et al. as inventors, which is hereby fully incorporated herein by reference for all purposes.

BACKGROUND

The disclosures herein relate in general to audio signal processing, and in particular to a method and system for active noise cancellation according to a type of noise.

A user may hear noise from a surrounding environment. A mechanical structure can attempt to physically buffer the user's ears against some of the noise, but the mechanical structure has limits. In addition to the mechanical structure, an active noise cancellation system can attempt to generate signals for cancelling at least some of the noise. Nevertheless, different techniques for active noise cancellation have respective shortcomings and trade-offs.

SUMMARY

Microphone signals are received from a microphone. The microphone signals represent first sound waves. A determination is made about a type of noise that likely exists in the first sound waves. In response to the type of noise, cancellation signals are generated by filtering the microphone signals with at least one of: a first filter in response to the type of noise indicating that a first type of noise likely exists in the first sound waves; and a second filter in response to the type of noise indicating that a second type of noise likely exists in the first sound waves. In response to the cancellation signals, second sound waves are output from a speaker for cancelling at least some noise in the first sound waves.

DETAILED DESCRIPTION

Figure 1:
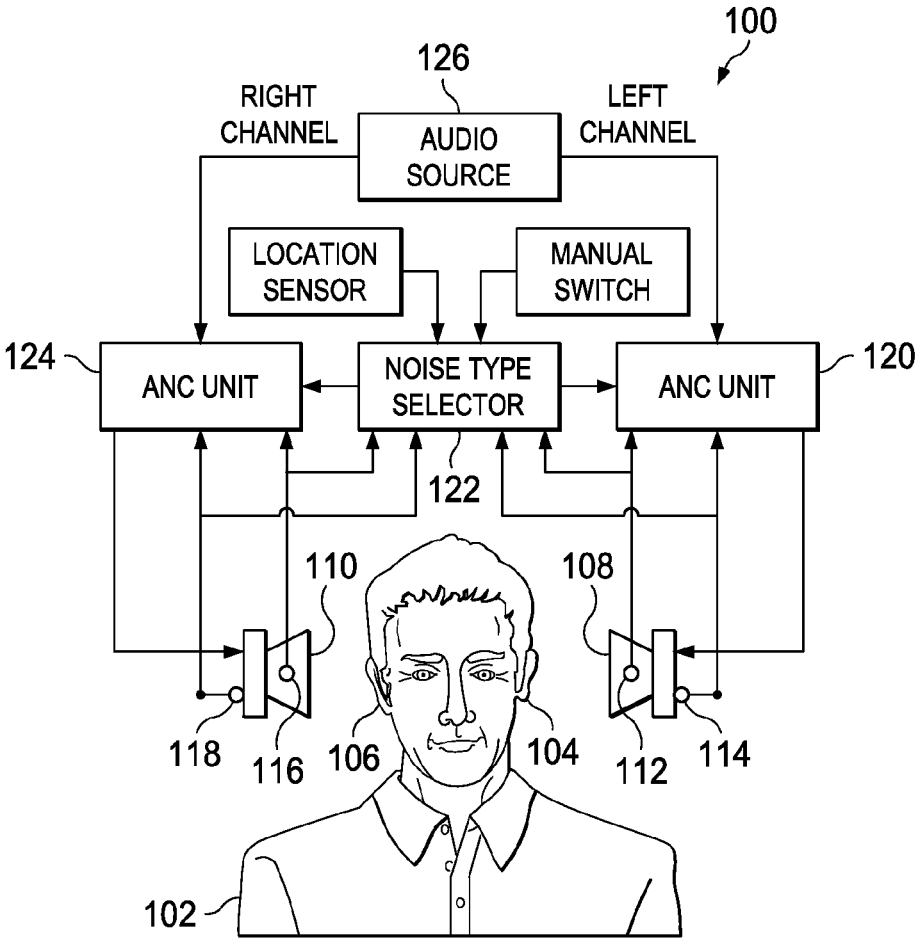
FIG. 1 is a block diagram of a system of the illustrative embodiments.

FIG. 1 is a block diagram of a system, indicated generally at 100, of the illustrative embodiments. A human user 102 has a left ear 104 and a right ear 106 for hearing. An earset 108, which at least partially fits over and/or into the ear 104, has: (a) a right side, which faces the ear 104, and which has a built-in speaker for outputting sound waves to the ear 104; and (b) a left side (opposite from the right side), which faces away from the ear 104 toward an environment around the left side of the earset 108 ("left surrounding environment"). Similarly, an earset 110, which at least partially fits over and/or into the ear 106, has: (a) a left side, which faces the ear 106, and which has a built-in speaker for outputting sound waves to the ear 106; and (b) a right side (opposite from the left side), which faces away from the ear 106 toward an environment around the right side of the earset 110 ("right surrounding environment"). In one example, the earsets 108 and 110 include mechanical structures that physically buffer the ears 104 and 106, respectively, against some noise from within the left and right surrounding environments.

The earset 108 is integral with: (a) an error microphone 112, which is located on the right (interior) side of the earset 108; and (b) a reference microphone 114, which is located on the left (exterior) side of the earset 108. The error microphone 112: (a) converts, into analog signals, sound waves from a space between the ear 104 and the right side of the earset 108 (e.g., including sound waves from the built-in speaker of the earset 108); and (b) outputs those signals. The reference microphone 114: (a) converts, into analog signals, sound waves from the left surrounding environment (e.g., ambient noise around the reference microphone 114); and (b) outputs those signals.

The earset 110 is integral with: (a) an error microphone 116, which is located on the left (interior) side of the earset 110; and (b) a reference microphone 118, which is located on the right (exterior) side of the earset 110. The error microphone 116: (a) converts, into analog signals, sound waves from a space between the ear 106 and the left side of the earset 110 (e.g., including sound waves from the built-in speaker of the earset 110); and (b) outputs those signals. The reference microphone 118: (a) converts, into analog signals, sound waves from the right surrounding environment (e.g., ambient noise around the reference microphone 118); and (b) outputs those signals.

Accordingly, the signals from the error microphone 112 and the reference microphone 114 represent various sound waves. An active noise cancellation ("ANC") unit 120: (a) receives and processes the signals from the error microphone 112 and the reference microphone 114; and (b) in response thereto, and in response to noise type information from a noise type selector 122, outputs analog signals for cancelling at least some noise in those sound waves. The built-in speaker of the earset 108: (a) receives the signals from the ANC unit 120; and (b) in response thereto, outputs additional sound waves for achieving the noise cancellation.

Similarly, the signals from the error microphone 116 and the reference microphone 118 represent sound waves. An ANC unit 124: (a) receives and processes the signals from the error microphone 116 and the reference microphone 118; and (b) in response thereto, and in response to the noise type information from the noise type selector 122, outputs analog signals for cancelling at least some noise in those sound waves. The built-in speaker of the earset 110: (a) receives the signals from the ANC unit 124; and (b) in response thereto, outputs additional sound waves for achieving the noise cancellation.

In one example, the ANC unit 120 optionally: (a) receives digital audio information from a left channel of an audio source 126; and (b) combines the left channel's audio into the signals that the ANC unit 120 outputs to the built-in speaker of the earset 108. Accordingly, in this example: (a) the built-in speaker of the earset 108 further outputs sound waves (e.g., music and/or speech) that are represented by the left channel's digital audio information, so that those sound waves are audible to the ear 104; and (b) the ANC unit 120 suitably accounts for those sound waves in its further processing of the signals from the error microphone 112 for cancelling at least some noise in those sound waves.

Similarly, the ANC unit 124 optionally: (a) receives digital audio information from a right channel of the audio source 126; and (b) combines the right channel's audio into the signals that the ANC unit 124 outputs to the built-in speaker of the earset 110. Accordingly, in this example: (a) the built-in speaker of the earset 110 further outputs sound waves (e.g., music and/or speech) that are represented by the right channel's digital audio information, so that those sound waves are audible to the ear 106; and (b) the ANC unit 124 suitably accounts for those sound waves in its further processing of the signals from the error microphone 116 for cancelling at least some noise in those sound waves.

The noise type selector 122 outputs the noise type information in response to: (a) the signals from the error microphones 112 and 116; (b) the signals from the reference microphones 114 and 118; (c) location information from a location sensor; and/or (d) selection information from a manual switch. The noise type information indicates a type of noise that likely exists within the left and right surrounding environments. Example types of noise include: (a) car noise; (b) aircraft noise; (c) office noise; and (d) generic noise.

In a first example, the user 102 operates the manual switch to select the type of noise, so that the noise type selector 122 outputs the noise type information to indicate the user-selected type of noise. In a second example, the noise type selector 122: (a) receives the signals from the error microphones 112 and 116, and from the reference microphones 114 and 118; (b) in response to those signals, determines the type of noise that likely exists within the left and right surrounding environments; and (c) outputs the noise type information according to such determination.

In a third example, the location sensor outputs the location information to indicate a then-current location of the system 100, so that the noise type selector 122 outputs the noise type information to indicate the type of noise that likely exists within the left and right surrounding environments at such then-current location. For example, in response to the location information indicating that an office is the then-current location of the system 100, the noise type selector 122 outputs the noise type information to indicate that office noise is the type of noise that likely exists within the left and right surrounding environments at such then-current location. In the illustrative embodiments, the location sensor is one or more of: (a) a proximity sensor for detecting whether the system 100 is located within a vicinity of a predetermined location that has a proximity transmitter; (b) a Wi-Fi sensor for detecting whether the system 100 is located within a vicinity of a predetermined location that has a Wi-Fi transmitter; and (c) a global positioning system ("GPS") sensor for determining the then-current location of the system 100 in response to signals from the GPS.

Figure 2:
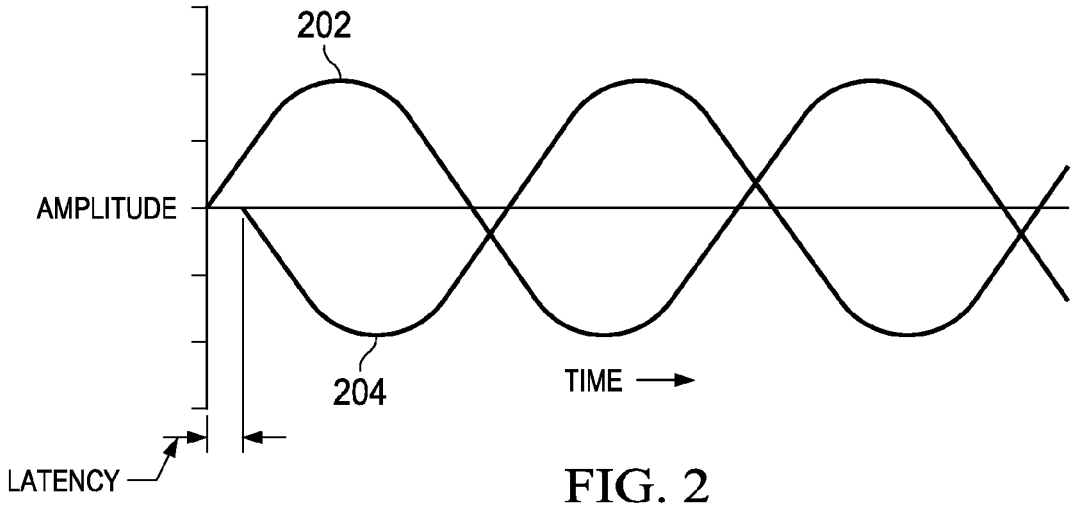
FIG. 2 is a graph of an example noise signal and an example noise cancellation signal.

FIG. 2 is a graph of: (a) an example noise signal 202, such as a signal from the error microphone 112 or the reference microphone 114; and (b) an example noise cancellation signal 204, such as a signal from the ANC unit 120 to the built-in speaker of the earset 108. As shown in FIG. 2, the signal 204 is substantially inverted from the signal 202, so that a phase of the signal 204 is shifted (relative to a phase of the signal 202) by ~180 degrees (e.g., 180 degrees plus a latency) across a bandwidth of the signals 202 and 204. For example, the latency may result from a processing cycle of the ANC unit 120. In this manner, the signal 204 is effective for cancelling at least some noise in a sound wave that is represented by the signal 202.

Figure 3:
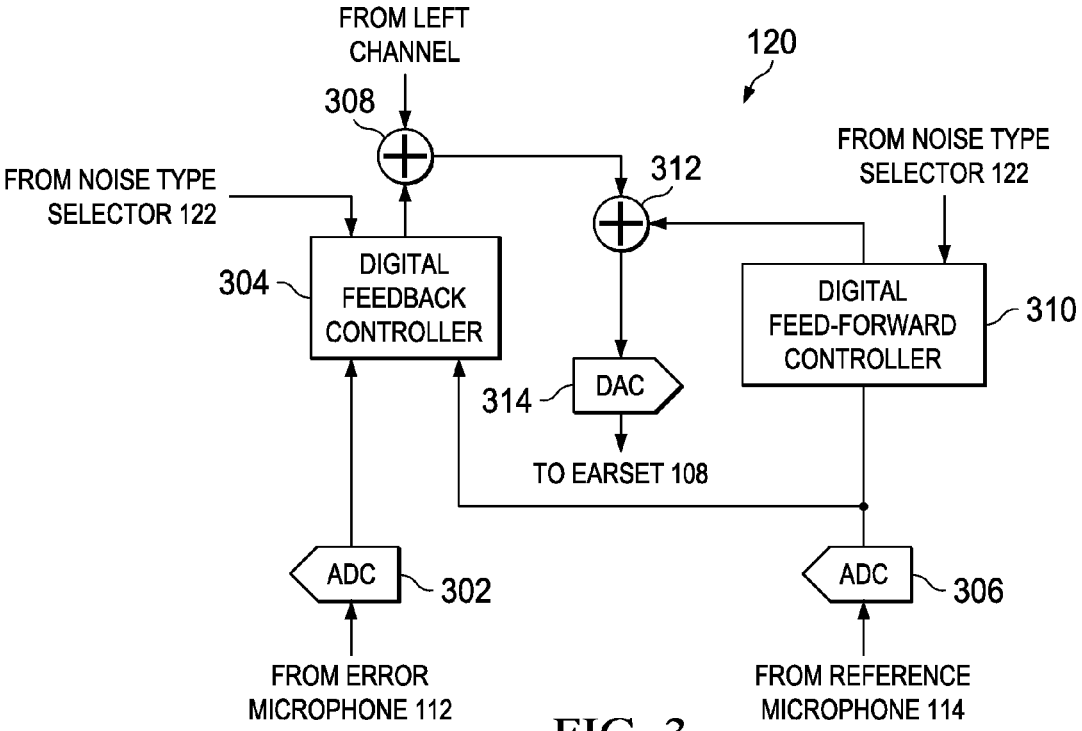
FIG. 3 is a block diagram of an active noise cancellation ("ANC") unit of the system of FIG. 1.

FIG. 3 is a block diagram of the ANC unit 120, which is a representative one of the substantially identical ANC units 120 and 124. The error microphone 112 is coupled through an analog-to-digital converter ("ADC") 302 to a digital feedback controller 304, so that the ADC 302: (a) from the error microphone 112, receives the analog signals that the error microphone 112 outputs in response to sound waves from the space between the ear 104 and the right side of the earset 108; (b) converts those analog signals into corresponding digital data that represent those sound waves; and (c) outputs such digital data to the feedback controller 304. Optionally (e.g., programmably), the reference microphone 114 is coupled through an ADC 306 to the feedback controller 304, so that the ADC 306: (a) from the reference microphone 114, receives the analog signals that the reference microphone 114 outputs in response to sound waves from the left surrounding environment; (b) converts those analog signals into corresponding digital data that represent those sound waves; and (c) outputs such digital data to the feedback controller 304.

In response to such digital data from the ADC 302, and optionally in response to such digital data from the ADC 306, the feedback controller 304: (a) performs digital processing to estimate noise in those sound waves; and (b) generates digital information for cancelling at least some of the estimated noise ("feedback cancellation information"). A digital mixer 308 combines the feedback cancellation information and the digital audio information (if any) that the mixer 308 receives from the left channel of the audio source 126 (collectively, "feedback audio information").

Further, the ADC 306 is connected to a digital feed-forward controller 310, which receives the digital data from the ADC 306. Optionally, the ADC 302 is connected to the feed-forward controller 310, which receives the digital data from the ADC 302. In response to such digital data from the ADC 306, and optionally in response to such digital data from the ADC 302, the feed-forward controller 310: (a) performs digital processing to estimate noise in those sound waves; and (b) generates digital information for cancelling at least some of the estimated noise ("feed-forward cancellation information").

In the illustrative embodiments, the feed-forward controller 310 outputs the feed-forward cancellation information in a manner that accounts for physical buffering (e.g., filtering) by a mechanical structure of the earset 108, so that: (a) the feed-forward controller 310 estimates noise from the left surrounding environment that such physical buffering fails to exclude from the space between the ear 104 and the right side of the earset 108 ("remaining noise"); (b) the feed-forward cancellation information is for cancelling at least some of the remaining noise; and (c) accordingly, the feed-forward cancellation information is substantially inverted (and its phase is shifted by ~180 degrees) from the remaining noise across a bandwidth thereof.

A digital mixer 312: (a) combines the feedback audio information (from the mixer 308) and the feed-forward cancellation information that the mixer 312 receives from the feed-forward controller 310 (collectively, "combined information"); and (b) outputs such combined information to a digital-to-analog converter ("DAC") 314. The DAC 314: (a) receives such combined information from the mixer 312; (b) converts such combined information into corresponding analog signals that represent such combined information; and (c) outputs those analog signals to the earset 108. The built-in speaker of the earset 108: (a) receives those analog signals from the DAC 314; and (b) in response thereto, outputs additional sound waves for achieving the noise cancellation.

In the ANC unit 120, the feedback controller 304 and the feed-forward controller 310 perform their respective operations by digital processing, with oversampling. The respective operations of the feedback controller 304 and the feed-forward controller 310 achieve respective bandwidths of cancellation that are: (a) digitally tunable (e.g., programmable coefficients of noise filtering); and (b) relatively large at high feedback loop gains. As shown in FIG. 3, the feedback controller 304 and the feed-forward controller 310 perform their respective operations in response to the noise type information from the noise type selector 122.

Figure 4:
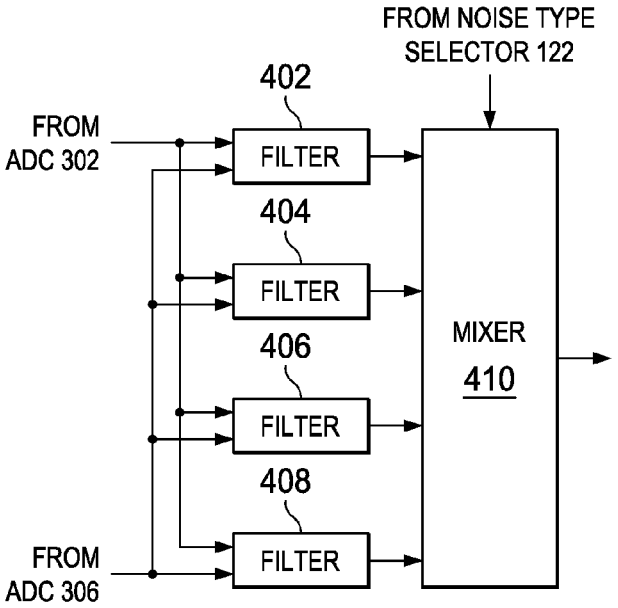
FIG. 4 is a block diagram of a representative controller of the ANC unit of FIG. 3.

FIG. 4 is a block diagram of a representative one of the feedback controller 304 or the feed-forward controller 310 ("representative controller"). In the example of FIG. 4, the representative controller performs its operations in response to the digital data from the ADC 302 and/or the ADC 306. A filter 402 is customized to generate first digital information for cancelling at least some of a first type of noise (e.g., car noise) in sound waves that are represented by such digital data.

Also, a filter 404 is customized to generate second digital information for cancelling at least some of a second type of noise (e.g., aircraft noise) in those sound waves. Further, a filter 406 is customized to generate third digital information for cancelling at least some of a third type of noise (e.g., office noise) in those sound waves. Moreover, a filter 408 is customized to generate fourth digital information for cancelling at least some of a fourth type of noise (e.g., generic noise) in those sound waves.

In response to the noise type information from the noise type selector 122, a digital mixer 410: (a) combines one or more of the first digital information (from the filter 402), the second digital information (from the filter 404), the third digital information (from the filter 406), and/or the fourth digital information (from the filter 408); and (b) such combined information is an output of the mixer 410. For example, in response to the noise type information indicating that the first and second types of noise likely exist within the left and right surrounding environments, the mixer 410 combines the first digital information and the second digital information. Accordingly, if the representative controller is the feedback controller 304, then: (a) the filters 402, 404, 406 and 408 operate in accordance with a feedback technique for noise cancellation; and (b) the output of the mixer 410 is received by the mixer 308. By comparison, if the representative controller is the feed-forward controller 310, then: (a) the filters 402, 404, 406 and 408 operate in accordance with a feed-forward technique for noise cancellation; and (b) the output of the mixer 410 is received by the mixer 312.

To reduce cancellation error and unpleasant artifacts (especially at mid-to-high frequencies), an ideal noise cancellation filter accounts for properties of: (a) mechanical structures of the earsets 108 and 110; and (b) the noise. As processing latencies increase, it becomes even more important to account for properties of the noise. Accordingly, the feedback controller 304 and the feed-forward controller 310 perform their respective operations in response to the noise type information from the noise type selector 122.

In one example: (a) the filter 402 is a low-pass filter that is tuned for cancellation of noise above a cutoff frequency; (b) the filter 404 is a band-pass filter that is tuned for cancellation of noise outside a first band of frequencies; (c) the filter 406 is a band-pass filter that is tuned for cancellation of noise outside a second band of frequencies; and (d) the filter 408 is a band-pass filter that is tuned for cancellation of noise outside a third band of frequencies. In such example, the first, second and third bands are non-overlapping with one another. In that manner, the filters 402, 404, 406 and 408 are tuned for cancellation of respectively different types of noise. Nevertheless, the filters 402, 404, 406 and 408 are tuned for cancellation of substantially equal amounts of any so-called "white" noise that may be represented by the digital data from the ADC 302 and/or the ADC 306.

The system 100 is formed by electronic circuitry components for performing the system 100 operations, implemented in a suitable combination of software, firmware and hardware. In one embodiment, such components include a digital signal processor ("DSP"), which is a computational resource for executing instructions of computer-readable software programs to process data (e.g., a database of information) and perform additional operations (e.g., communicating information) in response thereto. For operations of the DSP, such programs and data are stored in a memory of the DSP and/or in another computer-readable medium (e.g., hard disk drive, flash memory card, or other nonvolatile storage device) of the system 100.

In the illustrative embodiments, the ANC units 120 and 124 and the noise type selector 122 are together formed by (and together include) a single DSP, which is suitably programmed to perform their various operations, so that the DSP thereby implements the ANC units 120 and 124 and the noise type selector 122. In one example, the DSP is a suitably programmed stereo audio codec with embedded miniDSP. In comparison to the multi-filter technique of FIG. 4, a conventional adaptive filter technique (e.g., a single filter that adapts in a continuously variable manner): (a) would impose significantly more processing burden on the DSP's processing resources, especially in a wideband noise environment; and (b) would be potentially inefficient if the conventional adaptive filter technique relies upon high convergence factors.

In the illustrative embodiments, the DSP implements the filters 402, 404, 406 and 408 by applying different coefficients in response to the noise type information, so that the DSP applies: (a) a generic set of coefficients in response to the noise type information being unavailable (e.g., at startup); (b) a first set of coefficients to implement the filter 402 in response to the noise type information indicating the first type of noise, so that the first set of coefficients is customized for cancelling at least some of the first type of noise; (c) a second set of coefficients to implement the filter 404 in response to the noise type information indicating the second type of noise, so that the second set of coefficients is customized for cancelling at least some of the second type of noise; (d) a third set of coefficients to implement the filter 406 in response to the noise type information indicating the third type of noise, so that the third set of coefficients is customized for cancelling at least some of the third type of noise; and (e) a fourth set of coefficients to implement the filter 408 in response to the noise type information indicating the fourth type of noise, so that the fourth set of coefficients is customized for cancelling at least some of the fourth type of noise.

In one example, in response to the noise type information indicating the first type of noise, the DSP applies coefficients $a_{10}$, $a_{11}$, $a_{12}$, $b_{11}$ and $b_{12}$ (as the first set of coefficients) for cancelling at least some of the first type of noise (e.g., car noise). In the same example, in response to the noise type information indicating the second type of noise, the DSP applies coefficients $a_{20}$, $a_{21}$, $a_{22}$, $b_{21}$ and $b_{22}$ (as the second set of coefficients) for cancelling at least some of the second type of noise (e.g., aircraft noise).

In response to a change in the noise type information, the DSP transitions (e.g., gradually) from a previous set of coefficients to a replacement set of coefficients at a rate that reduces the human ear's perception of such transition. For example, if the previous set of coefficients is the second set of coefficients, and if the replacement set of coefficients is the first set of coefficients, then the DSP computes:

$$y_1[n]=a_{10}x[n]+a_{11}x[n-1]+a_{12}x[n-2]-b_{11}[n]y_1[n-1]-b_{12}[n]y_1[n-2]$$

$$y_2[n]=a_{20}x[n]+a_{21}x[n-1]+a_{22}x[n-2]-b_{21}[n]y_2[n-1]-b_{22}[n]y_2[n-2]$$

where x[n] is a microphone signal (from the error microphone 112 or the reference microphone 114) during a time interval n. After computing $y_1[n]$ and $y_2[n]$, the DSP transitions the representative controller's output y[n] from $y_2[n]$ to $y_1[n]$ by computing as:

$$y[n]=(1-\alpha_i[n])y_1[n]+\alpha_i[n]y_2[n]$$

while the DSP transitions (e.g., gradually) $\alpha_i[n]$ from 1 to 0 at a programmable rate.

In an alternative embodiment, in response to a change in the noise type information, the DSP transitions from the previous set of coefficients to the replacement set of coefficients by using a smoothing filter (e.g., alpha, dither or exponential) to reduce the human ear's perception of such transition, so that the DSP transitions y[n] by computing as:

$$y[n]=a_0[n]x[n]+a_1[n]x[n-1]+a_2[n]x[n-2]-b_1[n]y[n-1]-b_2[n]y[n-2]$$

where $a_0[n]$, $a_1[n]$, $a_2[n]$, $b_1[n]$ and $b_2[n]$ are time-dependent coefficients, which the DSP computes as: (a) $a_i[n]=(1-\alpha)a_{idest}+\alpha a_i[n-1]$, so that the DSP transitions $a_i[n]$ to $a_{idest}$, where $\alpha$ is a programmable constant (e.g., 0.99); and (b) $b_i[n]=(1-\alpha)b_{idest}+\alpha b_i[n-1]$, so that the DSP transitions $b_i[n]$ to $b_{idest}$.

Moreover, the DSP determines the noise type information in response to a spectral slope (e.g., noise spectral slope of signals from the reference microphones 114 and 118, or error spectral slope of signals from the error microphones 112 and 116). The DSP determines whether noise n within those signals includes more than a threshold level T of the first type of noise $n_1$, the second type of noise $n_2$, the third type of noise $n_3$, and/or the fourth type of noise $n_4$, where the threshold level T is tunable. For example, to determine whether the noise n includes more than the threshold level T of the first type of noise $n_1$ or the second type of noise $n_2$, the DSP: (a) obtains low-pass noise $n_{lpf}$ by filtering the noise n with a low-pass filter (e.g., the filter 402) that substantially removes noise above a first cutoff frequency (e.g., 250 Hz); (b) obtains band-pass noise $n_{bpf}$ by filtering the noise n with a band-pass filter (e.g., the filter 404) that substantially removes noise below the first cutoff frequency and above a second cutoff frequency (e.g., 500 Hz); (c) computes an energy $E\{n_{lpf}^2\}$ of the low-pass noise $n_{lpf}$, and computes an energy $E\{n_{bpf}^2\}$ of the band-pass noise $n_{bpf}$, where E is average energy over time; (d) normalizes for energy mismatch (between $n_{lpf}$ and $n_{bpf}$) by computing a value k that makes $E\{n_{lpf}^2\}=k\cdot E\{n_{bpf}^2\}$ for white noise; (e) in response to $E\{n_{lpf}^2\}>T\cdot E\{n_{bpf}^2\}$, generates the noise type information to indicate the first type of noise $n_1$; and (f) in response to $E\{n_{lpf}^2\}\leq T\cdot E\{n_{bpf}^2\}$, generates the noise type information to indicate the second type of noise $n_2$.

In a first alternative embodiment, the error microphone 112 and the reference microphone 114 remain located on opposite sides (of the earset 108) from one another, but the reference microphone 114 is spaced a farther distance (e.g., several inches or feet) away from the earset 108. In a second alternative embodiment, the error microphone 112 and the reference microphone 114 are located on the same side (of the earset 108) as one another, so that they convert sound waves that may be similar to (or even identical) to one another. In one example of the second alternative embodiment, the error microphone 112 and the reference microphone 114 are both located on the right side of the earset 108.

In the illustrative embodiments, a computer program product is an article of manufacture that has: (a) a computer-readable medium; and (b) a computer-readable program that is stored on such medium. Such program is processable by an instruction execution apparatus (e.g., system or device) for causing the apparatus to perform various operations discussed hereinabove (e.g., discussed in connection with a block diagram). For example, in response to processing (e.g., executing) such program's instructions, the apparatus (e.g., programmable information handling system) performs various operations discussed hereinabove. Accordingly, such operations are computer-implemented.

Such program (e.g., software, firmware, and/or microcode) is written in one or more programming languages, such as: an object-oriented programming language (e.g., C++); a procedural programming language (e.g., C); and/or any suitable combination thereof. In a first example, the computer-readable medium is a computer-readable storage medium. In a second example, the computer-readable medium is a computer-readable signal medium.

A computer-readable storage medium includes any system, device and/or other non-transitory tangible apparatus (e.g., electronic, magnetic, optical, electromagnetic, infrared, semiconductor, and/or any suitable combination thereof) that is suitable for storing a program, so that such program is processable by an instruction execution apparatus for causing the apparatus to perform various operations discussed hereinabove. Examples of a computer-readable storage medium include, but are not limited to: an electrical connection having one or more wires; a portable computer diskette; a hard disk; a random access memory ("RAM"); a read-only memory ("ROM"); an erasable programmable read-only memory ("EPROM" or flash memory); an optical fiber; a portable compact disc read-only memory ("CD-ROM"); an optical storage device; a magnetic storage device; and/or any suitable combination thereof.

A computer-readable signal medium includes any computer-readable medium (other than a computer-readable storage medium) that is suitable for communicating (e.g., propagating or transmitting) a program, so that such program is processable by an instruction execution apparatus for causing the apparatus to perform various operations discussed hereinabove. In one example, a computer-readable signal medium includes a data signal having computer-readable program code embodied therein (e.g., in baseband or as part of a carrier wave), which is communicated (e.g., electronically, electromagnetically, and/or optically) via wireline, wireless, optical fiber cable, and/or any suitable combination thereof.

Although illustrative embodiments have been shown and described by way of example, a wide range of alternative embodiments is possible within the scope of the foregoing disclosure.

What is claimed is:

1. A method performed by a combination of electronic circuitry components for active noise cancellation, the method comprising:

from a microphone, receiving microphone signals that represent first sound waves;

determining a type of noise that likely exists in the first sound waves;

in response to the type of noise, generating cancellation signals by filtering the microphone signals with at least one of: a first filter in response to the type of noise indicating that a first type of noise likely exists in the first sound waves; and a second filter in response to the type of noise indicating that a second type of noise likely exists in the first sound waves; and in response to the cancellation signals, outputting second sound waves from a speaker for cancelling at least some noise in the first sound waves;

wherein generating the cancellation signals includes:

generating the cancellation signals by filtering the microphone signals with at least one of: the first filter by generating first digital information in response to first coefficients for cancelling the first type of noise in the first sound waves; and the second filter by generating second digital information in response to second coefficients for cancelling the second type of noise in the first sound waves; and in response to a change in the type of noise from the first type of noise to the second type of noise, generating the cancellation signals by generating third digital information in response to time-dependent coefficients that transition from the first coefficients to the second coefficients at a rate that reduces a perception of the transition by a human ear.

2. The method of claim 1, wherein determining the type of noise includes:

in response to a spectral slope of the microphone signals, determining the type of noise.

3. The method of claim 1, wherein determining the type of noise includes:

from a sensor, receiving information that indicates a location of the combination of electronic circuitry components; and determining the type of noise as including a type of noise that likely exists at the location.

4. The method of claim 1, wherein the cancellation signals are analog signals, and wherein generating the cancellation signals includes:

converting at least one of the first and second digital information into the cancellation signals.

5. The method of claim 1, wherein the microphone is a first microphone, and wherein the microphone signals are first microphone signals, and comprising:

from a second microphone, receiving second microphone signals that represent the first sound waves, wherein generating the cancellation signals includes: generating the cancellation signals by filtering the first and second microphone signals with at least one of the first and second filters.

6. A system for active noise cancellation, the system comprising:

a combination of electronic circuitry components for: from a microphone, receiving microphone signals that represent first sound waves; determining a type of noise that likely exists in the first sound waves; in response to the type of noise, generating cancellation signals; and, in response to the cancellation signals, outputting second sound waves from a speaker for cancelling at least some noise in the first sound waves;

wherein generating the cancellation signals includes:

generating the cancellation signals by filtering the microphone signals with at least one of: a first filter in response to the type of noise indicating that a first type of noise likely exists in the first sound waves; and a second filter in response to the type of noise indicating that a second type of noise likely exists in the first sound waves;

generating the cancellation signals by filtering the microphone signals with at least one of: the first filter by generating first digital information in response to first coefficients for cancelling the first type of noise in the first sound waves; and the second filter by generating second digital information in response to second coefficients for cancelling the second type of noise in the first sound waves; and in response to a change in the type of noise from the first type of noise to the second type of noise, generating the cancellation signals by generating third digital information in response to time-dependent coefficients that transition from the first coefficients to the second coefficients at a rate that reduces a perception of the transition by a human ear.

7. The system of claim 6, wherein determining the type of noise includes:

in response to a spectral slope of the microphone signals, determining the type of noise.

8. The system of claim 6, wherein determining the type of noise includes:

from a sensor, receiving information that indicates a location of the system; and determining the type of noise as including a type of noise that likely exists at the location.

9. The system of claim 6, wherein the cancellation signals are analog signals, and wherein generating the cancellation signals includes:

converting at least one of the first and second digital information into the cancellation signals.

10. The system of claim 6, wherein the microphone is a first microphone, and wherein the microphone signals are first microphone signals, and wherein the combination of electronic circuitry components is for:

from a second microphone, receiving second microphone signals that represent the first sound waves, wherein generating the cancellation signals includes: generating the cancellation signals by filtering the first and second microphone signals with at least one of the first and second filters.

* * * * *